US005130717A

United States Patent [19]

Ewen et al.

[11] Patent Number: 5,130,717

[45] Date of Patent: Jul. 14, 1992

[54] ANTENNA HAVING ELEMENTS WITH PROGRAMMABLE DIGITALLY GENERATED TIME DELAYS

[75] Inventors: Kenneth Ewen, Phoenix; Fredrick W. Barrett, Glendale, both of Ariz.

[73] Assignee: Loral Defense Systems, Goodyear, Ariz.

[21] Appl. No.: 692,681

[22] Filed: Apr. 29, 1991

[51] Int. Cl.[5] ..... H01Q 3/22

[52] U.S. Cl. ..... 342/375

[58] Field of Search ..... 342/375

[56] References Cited

U.S. PATENT DOCUMENTS

| | | | |
|---|---|---|---|
| 3,005,960 | 10/1961 | Levenson . | |
| 3,518,669 | 9/1968 | Vogel . | |
| 4,229,739 | 10/1980 | Smith . | |
| 4,234,940 | 11/1980 | Iinuma | 367/105 |
| 4,246,585 | 1/1981 | Mailloux . | |
| 4,274,148 | 6/1981 | van't Hullenaar . | |
| 4,445,119 | 4/1984 | Works . | |
| 4,658,257 | 4/1987 | Izutani et al. . | |
| 4,688,045 | 8/1987 | Knudsen . | |
| 4,749,995 | 6/1988 | Hopwood et al. . | |

OTHER PUBLICATIONS

Victor C. Anderson, "Digital Beamformer", *SPIE vol.* 180 *Real Time Signal Processing II.* 1979 pp. 68–73.

*Primary Examiner*—Theodore M. Blum

*Attorney, Agent, or Firm*—Lowell W. Gresham; Jordan M. Meschkow; Don J. Flickinger

[57] ABSTRACT

An array antenna (12) in which dependent programmable and digitally generated time delays are imposed on signals passing through each antenna element (14) is disclosed. A beam steering computer (32) determines data values corresponding to delays needed at each element to form a desired beam angle. These data values are written into digital element signal processors (DESPs) (40) which are associated with each element in one-to-one correspondence. Each DESP (40) includes a waveform generator (30), which produces digitized samples synchronously with a reference clock signal. A stream of the digitized samples passes through and is delayed in a highly precise delay generator (54) before being converted to analog in a D/A converter (60). The analog signal is modulated (62), amplified (66), and then radiated at the associated element (14). Received signals are amplified (70), demodulated (72), converted to digital in an A/D converter (74), and then passed through the same delay generator (54). They are then re-converted to analog (60), modulated (62) back to RF, and combined (50) with other delayed RF signals. The delay generator (50) includes a register file (106) which receives a digitized waveform. A latch (86) receives delay data. The delay data programs a counter (80, 82) to delay the waveform for a variable, integral number of reference clock cycles. The delay data further programs a delay line (88) to impose a further fractional portion of a reference cycle delay on the waveform.

20 Claims, 4 Drawing Sheets

ANTENNA HAVING ELEMENTS WITH PROGRAMMABLE DIGITALLY GENERATED TIME DELAYS

TECHNICAL FIELD OF THE INVENTION

The present invention relates generally to beam formation in electronically steerable antenna arrays. More specifically, the present invention relates to an apparatus and method for imposing independent, programmable, digitally generated timing delays on signals passing through each of numerous antenna elements in an antenna array.

BACKGROUND OF THE INVENTION

Array antennas have numerous antenna or radiating elements spaced apart from one another in a predetermined configuration. The radiation received at or transmitted from the numerous elements combines so that the antenna array acts as a combined unit with directional characteristics. In particular, when an RF signal exhibits diverse phases as it passes through the numerous antenna elements of an array, a collective RF signal forms a beam that may be directed at a particular azimuth and/or elevation angle.

It is well known that by independently controlling phase shifts applied to signals passed through numerous antenna elements, antenna beams may be electronically formed or steered in desired directions. Antennas arrays which use such phase shifting are referred to as phased array antennas. However, when the product of the signals' fractional bandwidth and the tangent of the steering angle divided by the antenna beamwidth exceeds approximately 0.1, an undesirable problem known as squint begins to pose a serious problem.

Briefly, a given phase shifter shifts the phases of different frequency signals by the same amount when it is desired that the phase shift be proportional to the frequency thereby generating a constant time delay for all frequencies. Thus, a beam formed by a phased array antenna for a wide bandwidth signal is smeared over a range of azimuth and/or elevation angles, with frequency components farthest from the center frequency exhibiting the greatest deviation from the desired beam steering angle. Squint worsens as bandwidth increases, physical array size increases, and steering angle increases.

The problem of squint may be solved by replacing phase shifters in an antenna array with delay generators. While this solution is known in theory, practical implementations of time-delayed antenna arrays for electromagnetic signals have been difficult to achieve. Electromagnetic signals propagate at extreme speed, i.e. the speed of light. Electronic components which are compatible with this extreme speed and the needs of an antenna array are not conventionally available. In particular, the problem relates to the physical length of the propagation path required to obtain delay and the need to vary this length in small enough increments that beam quality is not degraded. Maximum propagation path lengths required are on the order of the antenna dimensions. Large arrays require large and extremely precise delays. Accordingly, conventional implementations of time-delayed array antennas have been limited to sub-array configurations of switched transmission line elements which compromise antenna performance and become increasingly infeasible as array size increases.

SUMMARY OF THE INVENTION

Accordingly, it is an advantage of the present invention that an improved digital element signal processor (DESP) which implements a highly precise and digitally programmable time delay is provided.

Another advantage of the present invention is that an improved time-delayed antenna array for use in connection with electromagnetic signals is provided.

Yet another advantage is that the present invention includes a modularized and programmable DESP which is associated with each element of a time-delayed antenna array.

Still another advantage is that the present invention delays a signal passing through an antenna element by a highly precise duration which may be varied in real time over a wide range of durations.

Another advantage is that the present invention delays a signal passing through an antenna element without merely relying on physical path length devices.

The above and other advantages of the present invention are carried out in one form within an antenna array having a plurality of antenna elements. The antenna array includes an elemental signal processor associated with one of the antenna elements. The elemental signal processor, which inserts a programmable delay into an information signal passed through its associated element, includes a digital waveform generator, a delay value supplying device, a first delaying device, and a second delaying device. The waveform generator provides a digitized waveform corresponding to the information signal. The digitized waveform includes a sequence of samples having a predetermined period between adjacent samples. The delay value supplying device supplies first and second delay values. The sum of the first and second delay values specifies a delay to be applied to the information signal in the element. The first delaying device couples to the waveform generator and to the delay value supplying device. It delays the digitized waveform by a first duration, which is substantially an integral number of the predetermined periods. The second delaying device couples to the delay value supplying device. It delays the digitized waveform by a second duration, which is a fraction of the predetermined period.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

DETAILED DESCRIPTION OF THE PREFERRED EMBODIMENT

Figure 1:
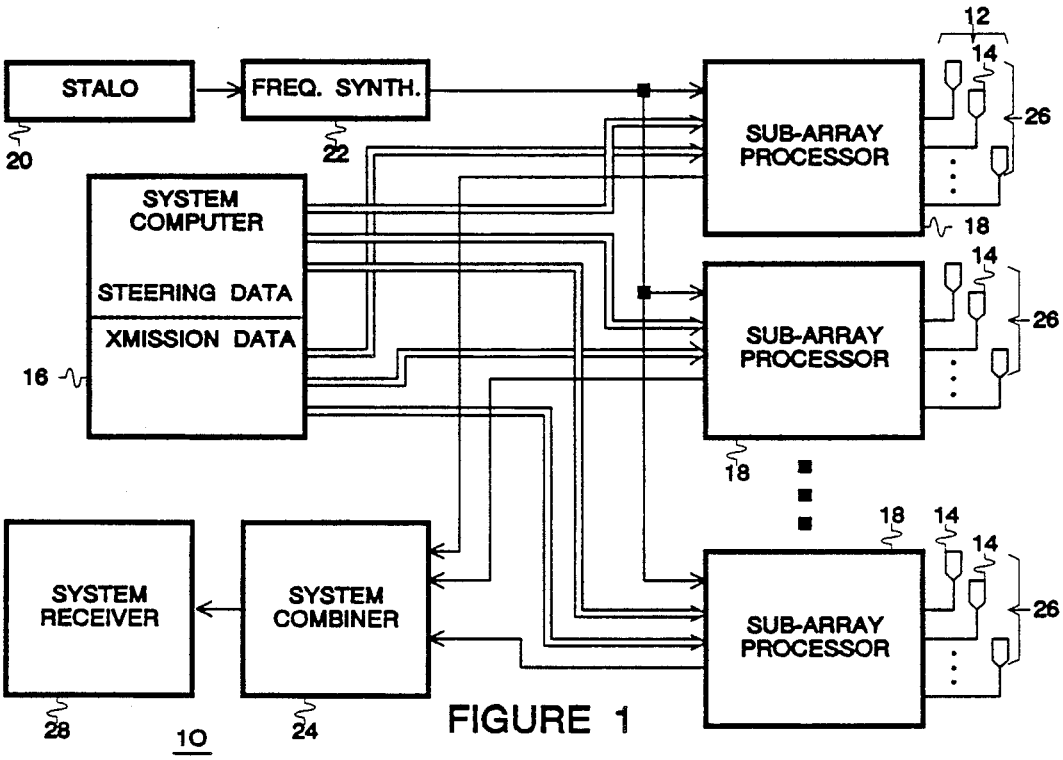
FIG. 1 shows a block diagram of a system comprised of a plurality of antenna arrays in accordance with the teaching of the present invention.

FIG. 1 shows a block diagram of a radio system 10 constructed in accordance with the teaching of the present invention. Radio system 10 employs an antenna array 12. Antenna array 12 includes a multiplicity of antenna elements 14 which are spaced apart from one another in a predetermined pattern. The precise pattern or spacing between elements 14 is not a critical factor of the present invention. In fact, one of the advantages of the present invention is that it may be adapted to a wide variety of antenna array topologies. Accordingly, antenna array 12 may be implemented on a single circuit board using stripline, microstrip, or related techniques. Antenna array 12 may also be implemented using many circuit boards physically spaced apart from one another, or may be implemented using any assortment of radiating elements spaced apart from one another in a predetermined 3-dimensional pattern.

The preferred embodiment of system 10 described herein is adapted for use in a radar or transponder application. Thus, a system computer 16 provides two types of data for use within system 10. The first type of data are steering data. Steering data are directed from system computer 16 to individual sub-array processors 18. In the preferred embodiment, sub-array processors 18 are substantially identical to one another, and any number of sub-array processors 18 may be included. Generally speaking, the steering data specify a desired azimuth and/or elevation angle to which a beam associated with antenna array 12 may be formed. Sub-array processors 18 are discussed in detail below in connection with FIGS. 2–5.

In addition, system computer 16 specifies data to be transmitted from antenna array 12. These data are transferred to sub-array processors 18 for further processing therein. System computer 16 may supply a digitized version of a baseband signal to be transmitted from antenna array 12. However, system computer 16 preferably specifies a single code that selects a particular one of a multiplicity of potential baseband waveforms for transmission from antenna array 12.

In the preferred embodiment of the present invention, each of sub-array processors 18 operates synchronously and in unison with one another. In other words, signal processing performed in sub-array processors 18 commences at the same instant in time and continues synchronously therefrom. However, this does not mean that radiation or receipt of signals at elements 14 occurs in unison, as discussed below.

Accordingly, system 10 includes a stable local oscillator (STALO) 20 which provides a timing reference for the entire system 10. STALO 20 couples to a frequency synthesizer 22 which uses the STALO reference to generate an assortment of carrier and other clock reference and timing signals (discussed below) which are distributed to each of sub-array processors 18. Although not shown, system computer 16 may enable and disable these timing signals in accordance with system needs.

In addition, system 10 includes a system combiner 24. In the preferred embodiment, each of sub-array processors 18 generates a received RF sub-array signal, which represents the combined sum of all RF signals received at elements 14 from an associated sub-array 26. These RF sub-array signals are routed to system combiner 24 where they are combined into a single RF system signal that represents the entire signal received by antenna array 12. The combined RF system signal is routed to a system receiver 28. System receiver 28 converts the RF system signal to baseband and performs any other processing that may pertain to the application in which system 10 is employed.

Figure 2:
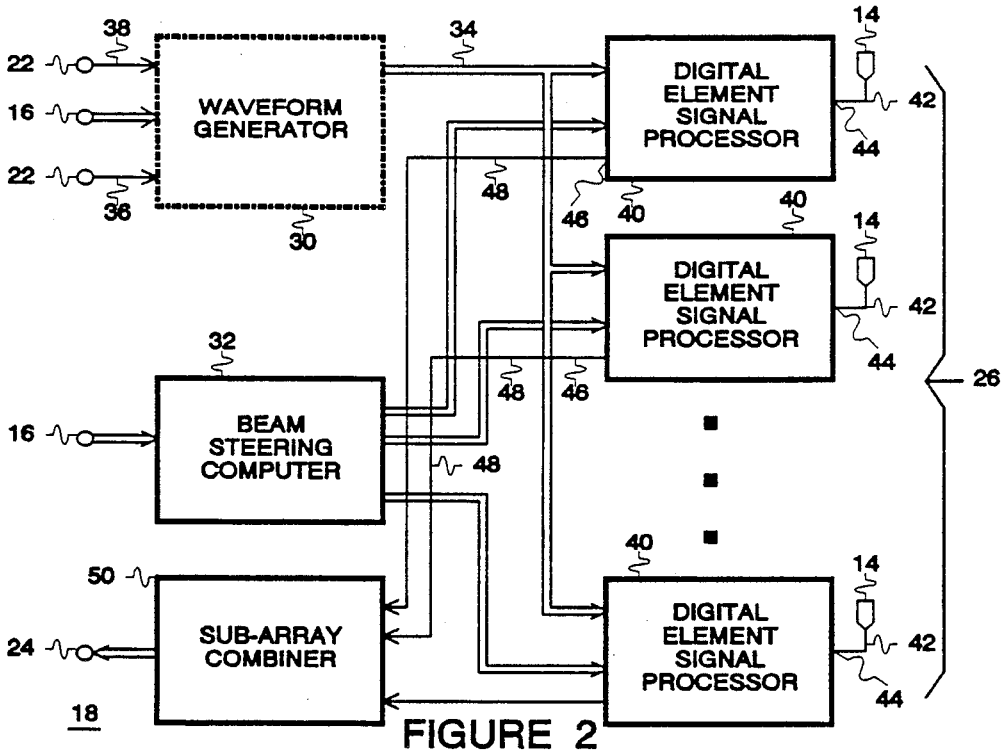
FIG. 2 shows a block diagram of a sub-array processor included in the system of the present invention and comprised of a plurality of digital element signal processors (DESPs)

FIG. 2 shows a block diagram of a single sub-array processor 18, which is configured in accordance with the teaching of the present invention. As discussed above in connection with FIG. 1, all sub-array processors 18 are substantially identical to one another. Thus, the block diagram shown in FIG. 2 represents any one of sub-array processors 18.

Sub-array processor 18 includes an optional waveform generator 30 and a beam steering computer 32, each of which receive control data from system computer 16. Waveform generator 30 provides a digitized waveform at an output 34 thereof. The digitized waveform consists of a series of digital samples which are updated at a predetermined and substantially constant rate. This digitized waveform is produced in response to the control data received from system computer 16, which define a baseband or information signal waveform to be transmitted from sub-array 26. This waveform may be a wideband waveform.

The timing of this digitized waveform is controlled by timing signals received from frequency synthesizer 22 (see FIG. 1). For example, waveform generator 30 may start producing a string of samples which characterize the waveform after receipt of a start signal at a timing input 36 and synchronized with a reference clock signal received at a timing input 38. Waveform generator 30 is considered optional because it may be included within digital element signal processors (DESPs) 40 (discussed below) in a more expansive implementation of the present invention. Alternately, waveform generator 30 may be incorporated within system computer 16, as discussed above, in a less expansive implementation of the present invention.

Beam steering computer 32 generates data that describe the precise time delays needed at each element 14 to form a beam specified by system computer 16. The precise techniques used in calculating these delays are known to those skilled in the art and are beyond the scope of the present invention. Generally speaking, however, such calculations are based upon the propagation speed of electromagnetic radiation (i.e. the speed of light), the physical spacing and relative orientation between elements 14 within sub-array 26, and the differences in length between feed networks 42 that couple to associated elements 14. Beam steering computer 32 may calculate these time delays in real time in response to steering data supplied from system computer 16. Alternately, beam steering computer 32 may store in a memory thereof (not shown) data tables describing the specific delays needed to achieve various beam angles. These tables may be worked out prior to the manufacture of radio system 10. Computer 32 may then simply access an appropriate table in response to steering data supplied from system computer 16. Beam steering computer 32 outputs this delay data as digital words.

The digitized waveform data and delay data are routed to digital element signal processors (DESPs) 40. In the preferred embodiment, DESPs 40 are substantially identical to one another, and any number of DESPs 40 may be associated with a single sub-array processor 18. In fact, each of DESPs 40 are preferably implemented as a single integrated component. Thus, a DESP 40 represents a modular component which can be produced in large quantity and at relatively low cost for incorporation in radio system 10 (see FIG. 1).

One DESP 40 is provided for each element 14. As shown in FIG. 2, one single digitized waveform is supplied to all DESPs 40, but unique delay data from beam steering computer 32 are provided for each DESP 40. Each DESP 40 includes an RF port 44 that couples through its own feed network 42 to a corresponding element 14. In addition, each DESP 40 includes an RF port 46 through which an RF signal received at the associated element 14 is routed. RF ports 46 from DESPs 40 couple through dedicated feed networks 48 to a sub-array combiner 50. Preferably, feed networks 48 are substantially identical to one another so that propagation delays associated therewith are about the same for all sub-array processors 18. Combiner 50 combines all RF signals received at sub-array 26, after being processed in DESPs 40, into a single RF sub-array signal. This RF sub-array signal is routed to system combiner 24, as discussed above.

Figure 3:
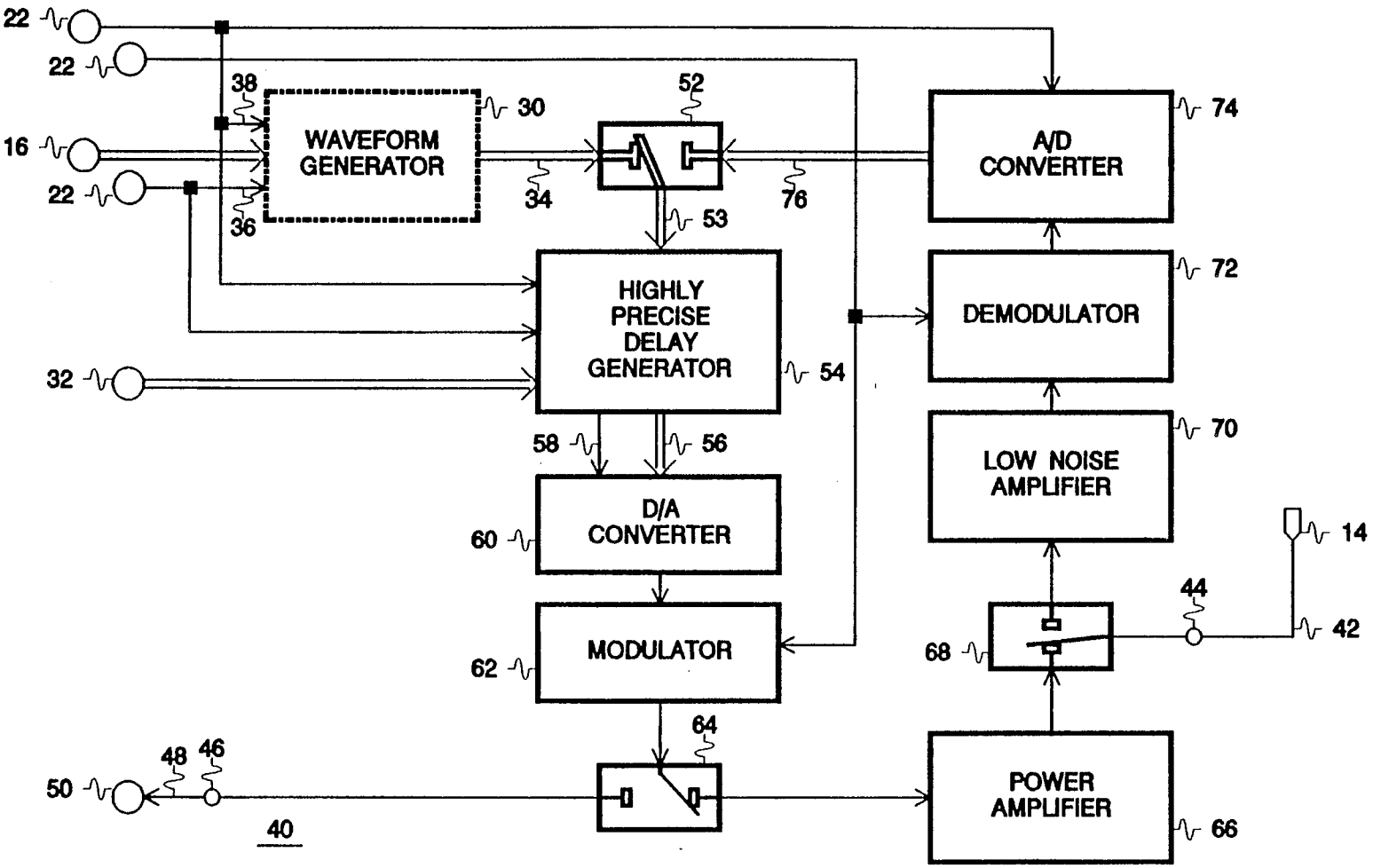
FIG. 3 shows a block diagram of a DESP constructed in accordance with the teaching of the present invention.

FIG. 3 shows a block diagram of a DESP 40. As discussed above, waveform generator 30 may optionally be included within DESP 40, rather than in sub-array processor 18 (see FIG. 2). For completeness, FIG. 3 shows waveform generator 30 included within DESP 40. As discussed above, waveform generator 30 may produce a string of digital data samples which characterize a waveform in response to data supplied from system computer 16. The string of samples begins after the receipt of a start signal at timing input 36 and flows synchronously with a reference clock signal received at a timing input 38. In the preferred embodiment, waveform generator 30 produces the waveform samples at least until a stop signal is received at timing input 36. The start and stop signals are referred to as "start mode 1" and "start mode 2" signals, respectively, below. Both are generated by frequency synthesizer 22. Moreover, with reference to FIG. 1, the start, stop, and reference clock signals are preferably routed to each of sub-array processors 18 and DESPs 40 therein, in such a manner that propagation delays are substantially equivalent from frequency synthesizer 22 for all of the DESPs 40.

The digitized waveform produced by waveform generator 30 is routed over digital bus 34 to a first input of a switch or multiplexer 52. An output of switch 52 drives a digital bus 53 that couples to a waveform input of a highly precise delay generator 54. In the transponder or radar application to which the preferred embodiment of the present invention is dedicated, switch 52 routes digital data from bus 34 to bus 53 during a transmit mode of operation. Delay generator 54 is discussed in detail below in connection with FIG. 4. Generally speaking, however, delay generator 54 imposes a delay on waveform samples transmitted therethrough. This delay is variable, and the precise value of the delay to be applied is controlled in response to delay data (discussed above) from beam steering computer 32. Moreover, this delay is highly precise, as is required for processing electromagnetically radiated signals, and is variable over a wide range of delays, as is required to accommodate a wide range of beam angles and large antenna array topologies.

Delay generator 54 outputs delayed waveform data on a digital data bus 56 and outputs a delayed clock signal at an output 58. The delayed clock signal is used by a D/A converter 60 to latch the data presented on bus 56 therein for conversion from digital to analog. An analog output from D/A converter 60 couples to a signal input of a single sideband modulator 62, and a carrier input to modulator 62 receives a carrier signal provided from frequency synthesizer 22. Modulator 62 produces an RF signal, which is routed to a switch 64.

In the radar or transponder application to which the preferred embodiment of the present invention is dedicated, switch 64 routes the RF signal to a first output thereof during a transmit mode of operation. The first output of switch 64 couples to an input of an RF power amplifier 66. An output of amplifier 66 couples to a first port of a switch 68. Switch 68 connects its first port to a second port during the transmit mode of operation. The second port of switch 68 couples to RF port 44 of DESP 40 and to feed network 42. As discussed above, DESP 40 communicates through feed network 42 with element 14.

Accordingly, in transmitting a waveform, waveform generator 30 provides a digitized characterization of a waveform to be transmitted. The waveform is delayed in delay generator 54. With reference to FIGS. 1 and 2, the delay to be applied in a DESP 40 to form a desired beam angle is uniquely determined for that DESP 40 by beam steering computer 32, and programmed into that DESP 40. Referring back to FIG. 3, after delay generator 54 inserts the programmed delay into the flow of digitized waveform data, D/A converter 60 converts the flow of digitized waveform data into a baseband analog signal. Modulator 62 modulates the baseband analog signal to RF, and the RF signal is amplified in amplifier 66 then routed over feed network 42 to element 14, where it is broadcast.

For a receive mode of operation, switch 68 of DESP 40 routes an RF signal received at element 14 and transmitted through feed network 42 from its second port to a third port. The third port of switch 68 couples to an input of a low noise RF amplifier 70, and an output of amplifier 70 couples to an input of a demodulator or down converter 72. A carrier input of demodulator 72 receives the same carrier signal that is used to modulate, as discussed above in connection with modulator 62. Thus, the preferred embodiment defines a coherent system. An output of demodulator 72 provides a baseband signal and couples to an input of an A/D converter 74. A/D converter 74 provides a flow of digitized data sampled from the received baseband signal at a rate determined by the reference clock, described above. An output of A/D converter 74 supplies this flow of digitized data through a digital bus 76 to third input port of switch 52. In the receive mode of operation, switch 52 routes bus 76 to bus 53. Thus, the flow of digitized receive signal samples is routed through delay generator 54, D/A converter 60, and modulator 62, as discussed above, and modulated back to RF. In the receive mode of operation, switch 64 routes the RF signal output from modulator 62 to a third port of switch 64 and to RF port 46 of DESP 40. Thereafter, the RF receive signal is transmitted over feed network 48 to combiner 50, where it is combined with other RF receive signals, as discussed above.

Accordingly, delay generator 54 is utilized for both transmit and receive mode of operation to insert a delay into baseband signals propagating through element 14. This delay, when taken into consideration with delays imposed at all others of elements 14, forms a desired antenna beam for both transmit and receive modes of operation.

Figure 4:
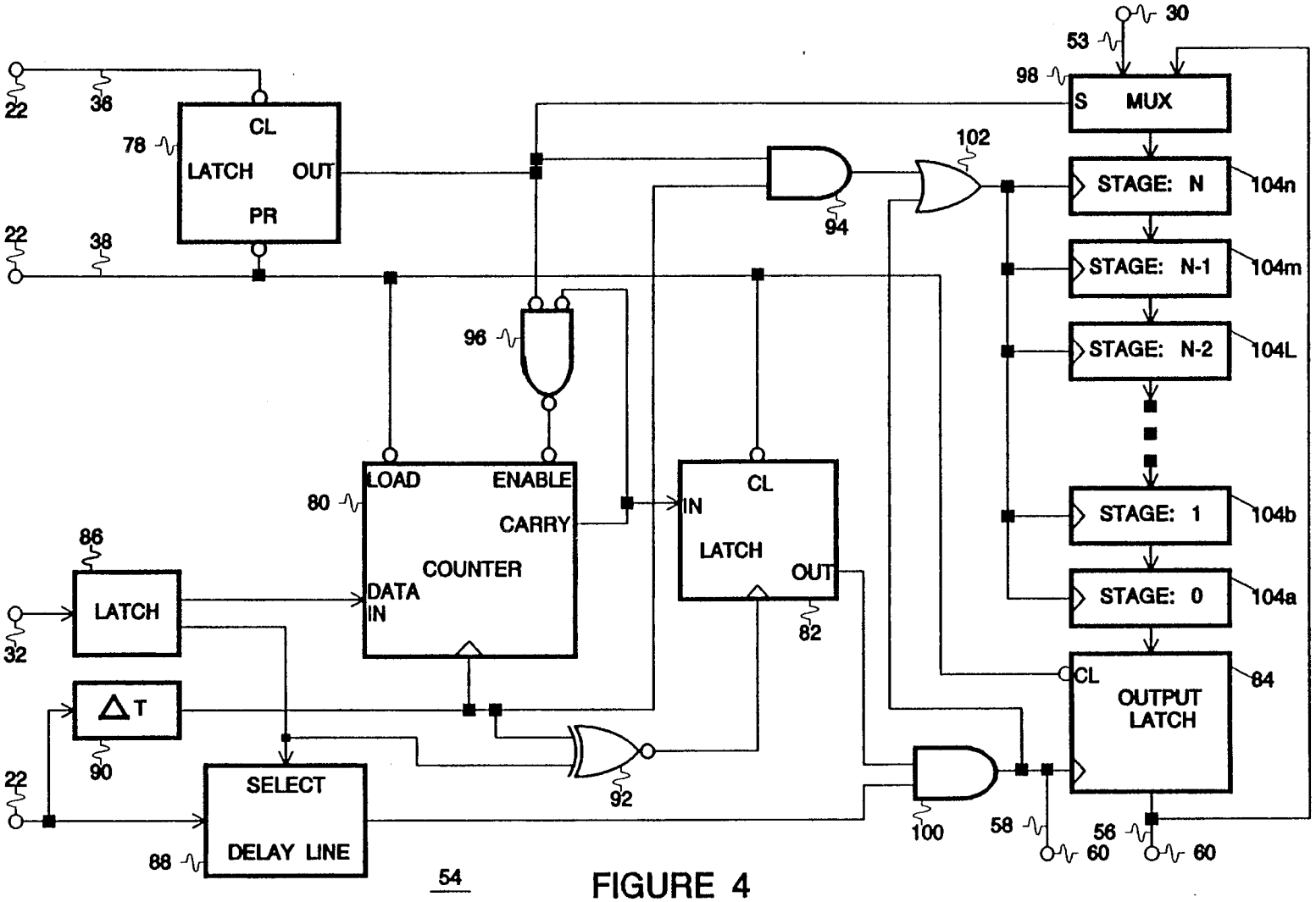
FIG. 4 shows a block diagram of a highly precise delay generator employed by the DESP of the present invention.

FIG. 4 shows a block diagram of a delay generator 54 constructed in accordance with the teaching of the present invention. A latch 78 has "preset" and "clear" inputs, which couple to timing inputs 36 and 36', respectively, of delay generator 54. The present input is adapted to receive the start mode 1 signal, and the clear input is adapted to receive the start mode 2 signal, both discussed above. Input 36 additionally couples to a load data input of a counter 80, a clear input of a latch 82, and a clear input of an output latch 84. A latch 86, which is capable of receiving and retaining an entire word of data, preferably 16–20 bits, has an input that couples to beam steering computer 32. A most significant portion of this entire word of data, preferably the most significant 9–11 bits, couples to a data input of counter 80. A least significant portion of this entire word of data, preferably the least significant 7–9 bits, couples to a selection input of a delay line 88.

A signal input of delay line 88 is adapted to receive the system reference clock, discussed above and supplied from frequency synthesizer 22. A static delay element 90 also has a signal input which is adapted to receive the system reference clock. Delay line 88 delays the reference clock by a variable amount which is specified by the data present at its selection input. In the preferred embodiment, the maximum delay imposed by delay line 88 is in the 200–600 picosecond (ps) range, and the variable amount of delay may be programmed in steps of around 1 ps. Delay element 90 imposes an invariant delay on the reference signal, as discussed below.

A signal output of delay element 90 couples to a clock input of counter 80, a first input of an EXCLUSIVE NOR logic element 92, and a first input of an AND logic element 94. A second input of EXCLUSIVE NOR element 92 is adapted to receive the most significant bit of the least significant portion of the data word supplied to latch 86 from beam steering computer 32. In other words, this second input of element 92 receives the most significant bit of the variable delay programmed for delay line 88. An output of EXCLUSIVE NOR element 92 couples to a clock input of latch 82. A terminal count output of counter 80, such as a borrow, carry, or the like, couples to a data input of latch 82, and to a first input of an inverted AND element 96. An output of element 96 couples to an enable input of counter 80. An output of latch 78 couples to a second input of element 96, a second input of AND element 94, and a selection input of a multiplexer 98. An output of latch 82 couples to a first input of an AND element 100, and a signal output of delay line 88 couples to a second input of AND element 100. An output of AND element 94 and an output of AND element 100 couple to first and second inputs of an OR element 102, and an output of OR element 102 couples to clock inputs of registers **104*a*–104*n* of a register file 106. The output of AND element 100 also couples to a clock input of latch 84 and is provided as delayed reference clock output 58 from delay generator 54. As discussed above in connection with FIG. 3, D/A converter 60 utilizes delayed reference clock output 58** to time conversions of digital samples into an analog signal.

A first data input of multiplexer 98 is adapted to receive data from waveform generator 30, as discussed above in connection with FIG. 3. In the preferred embodiment, this data is presented through data bus 53, which preferably carries 12–16 bits of data in parallel per sample. The output of multiplexer 98 couples to a data input of register file 106. Register file 106 includes a predetermined number of registers 104, preferably in the range of $2^9$–$2^{11}$ registers. Registers 104 are coupled in series. In other words, an output of one of registers 104 couples to an input of a subsequent register 104 within register file 106. A final stage 0 register 104, referred to as register **104*a* in FIG. 4, has an output which couples to an input of latch 84. An output of latch 84 couples through data bus 56 to D/A converter 60, as discussed above. The output of latch 84 also couples to a second data input of multiplexer 98**.

Figure 5:
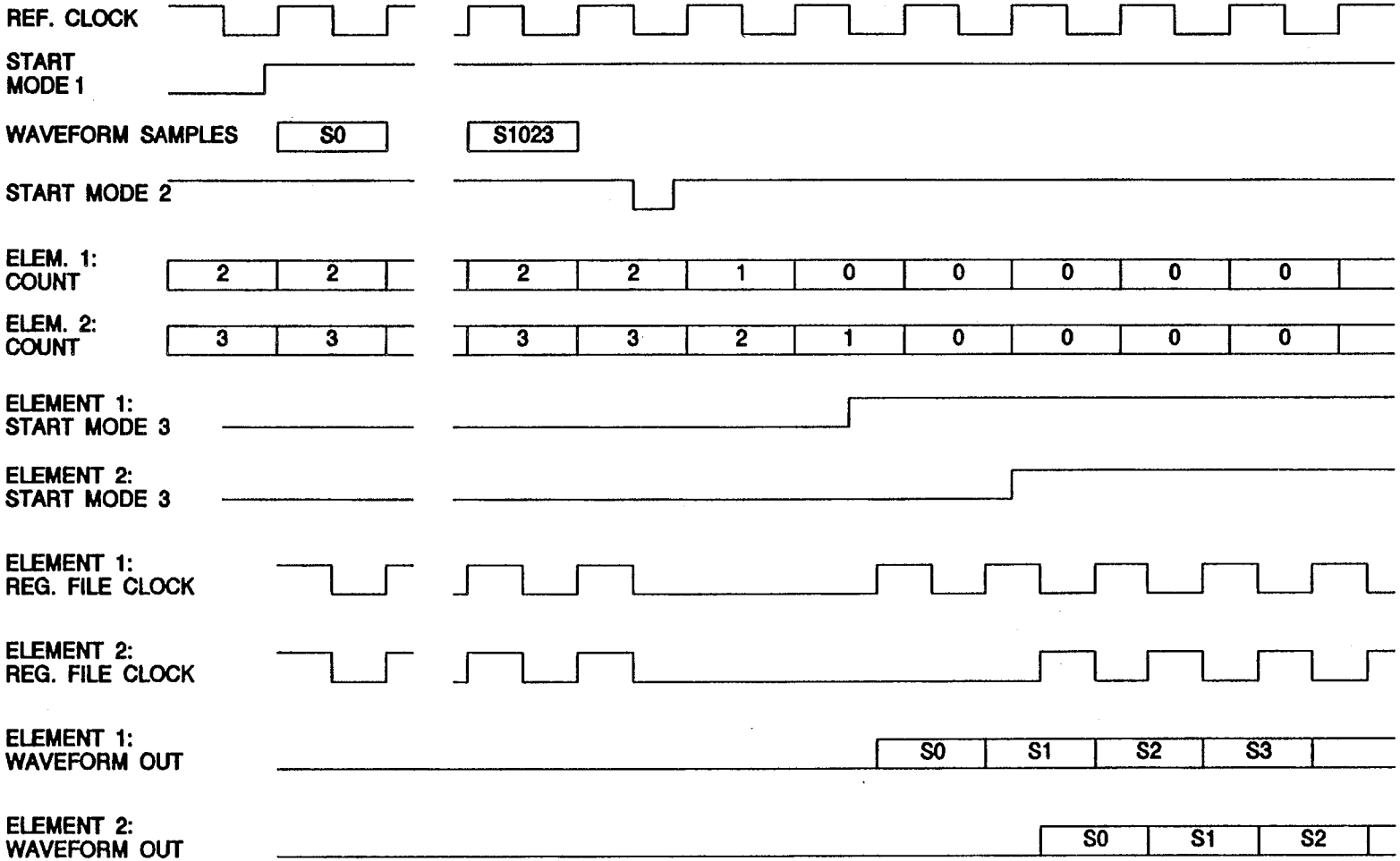
FIG. 5 shows a timing diagram which illustrates the operation of the present invention.

FIG. 5 shows a timing diagram that illustrates the operation of two of delay generators 54 within system 10 (see FIG. 1) in an example situation for transmitting a baseband waveform. This example situation imposes a delay of 2.75 reference clock cycles on the waveform propagating through a first delay generator 54 (element 1) and a delay of 4.25 reference clock cycles on the waveform propagating through a second delay generator 54 (element 2). Those skilled in the art will appreciate that such delays are entirely arbitrary and are chosen only for the purposes of teaching the present invention. The delays are independently programmable for each DESP 40 (see FIGS. 2–3) within system 10, and may take any value up to around a number of reference clock cycles equivalent to the number of registers 104 included within register file 106 (see FIG. 4). As discussed above, a determination of the precise delay values required for all DESPs 40 within system 10 to achieve a desired beam angle is beyond the scope of the present invention. For the purposes of the present invention, such delay values are determined in beam steering computers 32 of sub-array processors 18 (see FIGS. 1–2).

With reference to FIGS. 4 and 5, beam steering computer 32 first writes the delay value into latches 86 of delay generators 54. For the present example, latch 86 for element 1 receives a digital data word which corresponds to the value 2.75, and latch 86 for element 2 receives a digital data word which corresponds to the value 4.25. Those skilled in the art will recognize that these precise values need not be written into latches 86. Rather, beam steering computer 32 may first perform an algorithm which causes this data to appropriately control the specific hardware implementation of delay generator 54. For example, in the preferred embodiment shown in FIG. 4, if a delay to be programmed calls for a fractional portion of the delay to be less than ½ of a cycle, then the integer portion of the delay is decreased by 1. The reasons for this adjustment are discussed below. Thus, to program delays of 2.75 and 4.25 cycles, data values of 2.75 and 3.25, respectively, are loaded into respective latches 86.

After delay values have been programmed into latches 86, DESPs 40 (see FIG. 2) are prepared to operate. Such operation begins after the start mode 1 signal is received or initially placed at a high level. The start mode 1 signal puts delay generator 54 into a first mode of operation. Latch 78 is preset, and multiplexer 98 is controlled to route data from waveform generator 30 into register file 106. In addition, output latch 84 is preset with a predetermined initial value, such as zero, latch 82 is cleared, and counter 80 is loaded with the most significant portion of the data word written into latch 86. The most significant portions of these words may be viewed as the portions of the delay values discussed above which are to the left of the radix points. Thus, counter 80 for element 1 is loaded with a 2 and counter 80 for element 2 is loaded with a 3. In the embodiment of the present invention shown in FIG. 4, counter 80 is set to count down and output a borrow signal as the terminal count signal. Even though the reference clock is a continuous clock, counter 80 does not begin counting at this point because it is disabled by the output from latch 78.

After the receipt of the start mode 1 signal, waveform generator 30 supplies samples of the waveform to be transmitted. These samples are provided synchronously with the reference clock. Delay generators 54 for elements 1 and 2 operate identically. These samples are loaded into register file 106. Delay generators 54 remain in mode 1 until the entire register file 106 has been filled with samples. After the last sample, sample 1023 (S1023) for the example illustrated by FIG. 5, is clocked into register file 106, the start mode 2 signal is received. At this point, sample 0 (S0) has rippled through register file 106 and is residing in register 104*a*. Counter 80 still retains the value with which it was originally loaded, and output latch 84 continues to output its initial value.

When the start mode 2 signal is received, latch 78 is cleared, and delay generator 54 enters a second mode of operation. During this second mode of operation, register file 106 is not clocked, and output latch 84 continues to output its initial value. However, counter 80 now begins to count integral cycles of the reference clock, delayed by delay element 90. When counter 80 reaches its terminal count, which is 0 in the FIG. 5 example, the terminal count signal activates to disable further counting. Subsequently, this terminal count signal is latched into latch 82, and delay generator 54 then enters a third mode of operation. The start mode 3 signals illustrated in FIG. 5 represent the outputs from latches 82 for elements 1 and 2. For element 1 this third mode of operation begins before it begins for element 2 because of the delay values programmed into latches 86.

Delay line 88 is programmed with the least significant portion of the data written into latch 86. In other words, delay line 88 delays the reference clock signal by the amount specified to the right of the radix point discussed above. For element 1 this delay is 0.75 cycle, and for element 2 this delay is 0.25 cycle. When the terminal count signal is latched into latch 82, i.e. when the start mode 3 signal activates, AND element 100 becomes enabled, and the delayed reference clock begins. EXCLUSIVE NOR element 92 operates in cooperation with the decreased integral cycle count loaded into latch 86 to insure that no spurious clock signal occurs as AND element 100 is initially enabled, regardless of the phase of the clock signal output from delay line 88.

The delayed reference clock is then used to clock register file 106 together with output latch 84. Consequently, upon the first clock, sample 0 (S0) of the waveform appears on bus 56, and subsequent samples follow in synchronism with the delayed reference clock. As shown in FIG. 5, the waveform output from delay generator 54 for element 2 is delayed approximately 1.5 cycles from the waveform output from delay generator 54 for element 1. This is the desired result from programming delays of 4.25 and 2.75 into respective delay generators 54, i.e. a difference of 1.5 cycles.

When latch 78 was cleared to start mode 2, the selection input of multiplexer 98 was changed to route data from output latch 84 back into register file 106. Thus, during mode 3 the waveform may continuously repeat itself until a subsequent start mode 1 signal is received. Nothing restricts the rate at which data may be programmed into delay generators 54 and start mode 1 signals initiated. Thus, beam angles may be changed substantially in real time.

As discussed above, delay line 88 delays the reference clock signal by a programmable amount which is less than a cycle of the reference clock. In other words, delay line 88 inserts from 0%–100% of a cycle delay in the reference clock signal. After counter 80 and latch 82 have caused waveform data to be delayed within register file 106 for an integral number of reference clock cycles, this 0%–100% of a cycle delay is then applied to waveform data.

Of course, those skilled in the art will recognize that delay line 88 has some finite propagation delay associated therewith so that it cannot actually delay the reference clock 0% of a cycle. In addition, propagation delays are associated with AND element 100 and output latch 84. Accordingly, delay element 90 is included to compensate for these propagation delays by inserting an invariant delay which approximately equals these propagation delays. In this way, the integral cycle portion of the imposed delay maintains synchronism with the fractional cycle portions of delay are programmed. Of course, the delay imposed by delay element 90 applies an additional delay beyond that programmed by beam steering computer 32. However, the total relative delay remains unchanged. The total relative delay represents the total delay imposed at one element relative to the delays imposed at the other elements. This relative delay is to be distinguished from absolute delays. Absolute delays include relative delays, which are variable, plus all invariant delays. This invariant portion of absolute delay has no effect on overall beam formation for system 10 because it is substantially identical from element 14 to element 14.

This example shown in FIG. 5 and the above-presented discussion relate to a transmitted waveform. The same example and discussion apply to a received waveform as well. However, when a received waveform is being delayed, waveform samples are routed to delay generators 54 from A/D converters 74 (see FIG. 3) in synchronism with the reference clock signal.

Preferably, delay generator 54 is implemented within a monolithic microwave integrated circuit (MMIC) using GaAs semiconductor technologies, or the like. Thus, repeatability of performance between delay generators 54 of system 10 is insured. In addition, MMIC implementation insures a low cost of implementation and a modulator design which may be reliably and predictably adapted to a wide variety of applications. More preferably, D/A converter 60, switch 64, low noise amplifier 70, demodulator 72, A/D converter 74, and waveform generator 30 (see FIG. 4) may be included within the same MMIC to extend these benefits.

In summary, the present invention provides an improved digital element signal processor (DESP) which implements a highly precise, programmable, and digitally generated time delay. This DESP is utilized to implement an improved time-delayed antenna array for use in connection with electromagnetic signals. The DESP of the present invention represents a programmable module that is associated with each element of a time-delayed antenna. Information signals passing through the elements are delayed by highly precise durations which may be varied in real time over a wide range.

The present invention has been described above with reference to a preferred embodiment. However, those skilled in the art will recognize that changes and modifications may be made in this preferred embodiment without departing from the scope of the present invention. For example, antenna array 12 need not be partitioned into sub-arrays 26. The tasks performed by beam steering computer 32 could be incorporated within system computer 16. Those skilled in the art may easily incorporate the teaching of the present invention into multi-beam or digital beam formation applications. In addition, the specific implementations of delay generator 54 discussed in connection with FIG. 4 may be altered significantly to meet various application requirements. These and other changes and modifications which are obvious to those skilled in the art are intended to be included within the scope of the present invention.

What is claimed is:

1. In an antenna array having a plurality of antenna elements, an elemental signal processor for association with one of said antenna elements and for inserting a programmable delay into an information signal passed through said one element, said element signal processor comprising:

means for providing a digitized waveform corresponding to said information signal, said digitized waveform comprising a sequence of samples exhibiting a predetermined period between adjacent ones of said samples;

means for supplying first and second delay values wherein said first and second delay values together specify a total relative delay to apply to said information signal in said one element;

first means, coupled to said providing means and to said supplying means, for delaying said digitized waveform by a first duration which is responsive to said first delay value, said first duration being substantially an integral number of said predetermined periods; and second means, coupled to said supplying means, for delaying said digitized waveform by a second duration which is responsive to said second delay value, said second duration being less than said predetermined period.

2. An elemental signal processor as claimed in claim 1 wherein said second delaying means has a minimum delay value which is greater than zero, and said elemental signal processor comprises a third delaying means, coupled between said first and second delaying means, for delaying said digitized waveform by substantially said minimum delay value so that activation of said first delaying means is delayed to compensate for said minimum delay value of said second delaying means.

3. An elemental signal processor as claimed in claim 1 wherein said second delaying means comprises a delay line having a control input for specifying a discrete number of predetermined finite delays to impose on a signal passing therethrough, said predetermined finite delays being substantially more brief than said predetermined periods.

4. An elemental signal processor as claimed in claim 1 wherein said first delaying means comprises a register file having a predetermined number of registers coupled in series between a register file input and a register file output, said registers being clocked synchronously by a clock signal exhibiting said predetermined period.

5. An elemental signal processor as claimed in claim 4 wherein said first delaying means additionally comprises counter means coupled to said register file and responsive to a clock signal exhibiting said predetermined period, said counter means being configured to disable clocking of said register file for a variable period of time.

6. An elemental signal processor as claimed in claim 5 wherein said first delaying means is configured to operate in a first mode, in which said counter counts to a terminal count value and said register file is prevented from being clocked, and a second mode which occurs after said counter has reached its terminal count and in which said register file is clocked.

7. An elemental signal processor as claimed in claim 1 wherein said elemental signal processor additionally comprises means for supplying a reference clock exhibiting said predetermined period, and said second delaying means comprises:

means for imposing said second duration delay on said reference clock to generate a delayed reference clock; and a register having a data input coupled to said first delaying means and a clock input adapted to receive said delayed reference clock from said imposing means, so that said register outputs said digitized waveform samples therefrom synchronously with said delayed reference clock.

8. An elemental signal processor as claimed in claim 1 additionally comprising:

a digital-to-analog converter having an input coupled to at least one of said first and second delaying means and having an output;

a modulator having an input coupled to said digital-to-analog output and having an output; and a power amplifier having an input coupled to said modulator output and having an output adapted to provide an RF signal to said one element.

9. An elemental signal processor as claimed in claim 8 additionally comprising:

an RF amplifier having an input adapted to receive an RF signal from said one element and having an output;

a demodulator having an input coupled to said RF amplifier output and having an output;

an analog-to-digital converter having an input coupled to said demodulator output and having an output; and switching means having input terminals coupled to said digitized waveform providing means and to said analog-to-digital converter output and having an output terminal coupled to at least one of said first and second delaying means.

10. An elemental signal processor as claimed in claim 1 wherein said digitized waveform providing means comprises an analog-to-digital converter, and said element signal processor additionally comprises:

an RF amplifier having an input adapted to receive an RF signal from said one element and having an output; and a demodulator having an input coupled to said RF amplifier output and having an output coupled to said analog-to-digital converter.

11. An electronically steerable antenna array for passing wideband RF signals without squinting an antenna beam, said array comprising:

array computing means for specifying a beam angle;

array oscillator means for providing timing signals;

array transmission signal identifying means;

a multiplicity of substantially identical digital elemental signal processors (DESPs), wherein each of said DESPs comprises:

means for providing a digitized waveform in response to said transmission signal identifying means, said digitized waveform comprising a sequence of samples exhibiting a predetermined period between adjacent ones of said samples, said predetermined period being responsive to said oscillator means, means for supplying first and second delay values wherein the combination of said first and second delay values specifies a delay to apply to said digitized waveform, and said first and second delay values are responsive to said computing means, first means, coupled to said providing means and to said supplying means, for delaying said digitized waveform by a first duration, said first duration being substantially an integral number of said predetermined periods, second means, coupled to said supplying means, for delaying said digitized waveform by a second duration, said second duration being less than said predetermined period; and a multiplicity of radiating elements, wherein each of said radiating elements couples to a corresponding one of said second delaying means.

12. An electronically steerable antenna array as claimed in claim 11, wherein each of said DESPs additionally comprises:

a digital-to-analog converter having an input coupled to at least one of said first and second delaying means and having an output;

a modulator having an input coupled to said digital-to-analog output and having an output; and a power amplifier having an input coupled to said modulator output and having an output adapted to provide an RF signal to said corresponding one of said multiplicity of radiating elements.

13. An electronically steerable antenna array as claimed in claim 12, wherein:

each of said DESPs additionally comprises:

an RF amplifier having an input adapted to receive an RF signal from said one element and having an output, a demodulator having an input coupled to said RF amplifier output and having an output, an analog-to-digital converter having an input coupled to said demodulator output and having an output, and switching means having input terminals coupled to said waveform generator and to said analog-to-digital converter output and having an output terminal coupled to at least one of said first and second delaying means; and said antenna array additionally comprises an array combining means, coupled to said modulator outputs of each of said DESPs, for combining information signals received at each of said multiplicity of radiating elements into a single signal received by said antenna.

14. An electronically steerable antenna array as claimed in claim 11 wherein said first delaying means comprises a register file having a predetermined number of registers coupled in series between a register file input and a register file output and clocked substantially in synchronism by a clock signal exhibiting said predetermined period.

15. An electronically steerable antenna array as claimed in claim 14 wherein:

said first delaying means of each DESP additionally comprises counter means coupled to said register file and responsive to a clock signal exhibiting said predetermined period, said counter means being configured to disable clocking of said register file for a variable period of time; and said first delaying means of each DESP is configured to operate in a first mode, in which said counter counts to a terminal count value and said register file is prevented from being clocked, and a second mode which occurs after said counter has reached its terminal count and in which said register file is clocked.

16. An electronically steerable antenna array as claimed in claim 11 wherein each DESP additionally comprises means for receiving a reference clock exhibiting said predetermined period from said oscillator means, and said second delaying means of each DESP comprises:

means for imposing said second duration delay on said reference clock to generate a delayed reference clock; and a register having a data input coupled to said first delaying means and a clock input adapted to receive said delayed reference clock from said imposing means, so that said register outputs said digitized waveform samples therefrom synchronously with said delayed reference clock.

17. A method for inserting a digitally programmable time delay into an information signal passed through one of a multiplicity of antenna elements in an antenna array to form a squintless electronically steerable antenna array, said method comprising the steps of:

providing a digitized waveform corresponding to said information signal, said digitized waveform comprising a sequence of samples exhibiting a predetermined period between adjacent ones of said samples;

receiving first and second delay values, wherein said first and second delay values together specify a delay to apply to said information signal in said one element;

delaying said digitized waveform by a first duration which is substantially an integral number of said predetermined periods, said first duration being responsive to said first delay value; and delaying said digitized waveform by a second duration which is less than said predetermine period, said second duration being responsive to said second delay value.

18. A method as claimed in claim 17 wherein, when said second delay value specifies a delay substantially equal to zero, said second duration delaying causes a minimum delay which is greater than zero, and said method additionally comprises the step of delaying said digitized waveform by substantially said minimum delay so that performance of said first duration delaying step is delayed to compensate for said minimum delay associated with said second duration delaying step.

19. A method as claimed in claim 17 additionally comprising the steps of:

converting said digitized waveform, after said delaying steps, into an analog waveform;

modulating said analog waveform into an RF waveform; and amplifying said RF waveform to provide an amplified RF signal, said amplified RF signal being routed to said one antenna element.

20. A method as claimed in claim 19 additionally comprising the steps of:

receiving an RF signal at said antenna element;

amplifying said received RF signal to provide a received, amplified RF signal;

demodulating said received, amplified RF signal to provide an analog signal;

converting said analog signal into a second digitized waveform; and selecting one of said digitized waveform and said second digitized waveform for delay in said delaying steps.

* * * * *

UNITED STATES PATENT AND TRADEMARK OFFICE

CERTIFICATE OF CORRECTION

PATENT NO. : 5,130,717

DATED : July 14, 1992

INVENTOR(S) : Ewen et al.

It is certified that error appears in the above-identified patent and that said Letters Patent is hereby corrected as shown below:

In the Abstract, line 1, delete "dependent" and insert --independent--.

column 11 line 24, before the word "signal", delete "element" and insert --elemental--.

Signed and Sealed this

Tenth Day of August, 1993

*Attest:*

Michael K. Kirk

MICHAEL K. KIRK

*Attesting Officer*

*Acting Commissioner of Patents and Trademarks*